United States Patent [19]

Wiesner

[11] 4,241,769

[45] Dec. 30, 1980

[54] VIBRATING CONVEYOR FOR USE WITH PACKAGING APPARATUS

[76] Inventor: Dale E. Wiesner, Box 36A, Bancroft, Wis. 54921

[21] Appl. No.: 10,482

[22] Filed: Feb. 8, 1979

[51] Int. Cl.[3] ..... B65B 1/28; B65B 1/32

[52] U.S. Cl. ..... 141/83; 141/93; 141/248; 141/314; 198/753; 222/152

[58] Field of Search ..... 141/10–12, 141/51, 69–74, 83, 284, 313, 214, 224, 93, 248, 314; 198/753; 222/152, 199; 366/124; 406/75; 414/217, 291

[56] References Cited

U.S. PATENT DOCUMENTS

| | | | |
|---|---|---|---|
| 2,352,114 | 6/1944 | Muskat | 177/121 |
| 2,687,272 | 8/1954 | Schieser et al. | 177/121 |
| 2,852,045 | 9/1958 | Goodner | 141/314 |
| 2,884,901 | 5/1959 | Chandler et al. | 366/124 X |
| 3,068,996 | 12/1962 | Musschoot | 198/753 |
| 3,195,662 | 7/1965 | Joiner et al. | 177/81 |
| 3,799,280 | 3/1974 | Aarts | 177/53 |
| 3,913,634 | 10/1975 | Eisenberg | 141/51 |
| 4,056,132 | 11/1977 | Decrane | 141/285 |
| 4,152,255 | 5/1979 | Musschoot | 198/752 X |

OTHER PUBLICATIONS

General Kinematics Corp., Foundry Bulletin 3–GE.

Black Products Co., Black Diamond Valve Bag Fillers and Accessories.

*Primary Examiner*—Frederick R. Schmidt

*Attorney, Agent, or Firm*—Merchant, Gould, Smith, Edell, Welter & Schmidt

[57] ABSTRACT

A vibrating conveyor (10) is disclosed. The conveyor (10) includes a conveying table (14) and a frame (12) for supporting the table (14) for vibratory motion. The table (14) has an inlet area disposed generally in the middle of the table (14) for receiving particulate material to be conveyed. A first dispensing outlet (72) is disposed on a first side (26) of the table (14) and a second dispensing outlet (74) is disposed on the second side (34). A first pneumatic vibrator (116) is disposed on the first side (26) for vibrating the table (14) and conveying particulate material from the inlet area to the second outlet (74). A second pneumatic vibrator (118) is coupled to the table (14) on the second side (34) for vibrating the table (14) and for conveying particulate material from the inlet area to the first outlet (72).

23 Claims, 11 Drawing Figures

FIG. 6
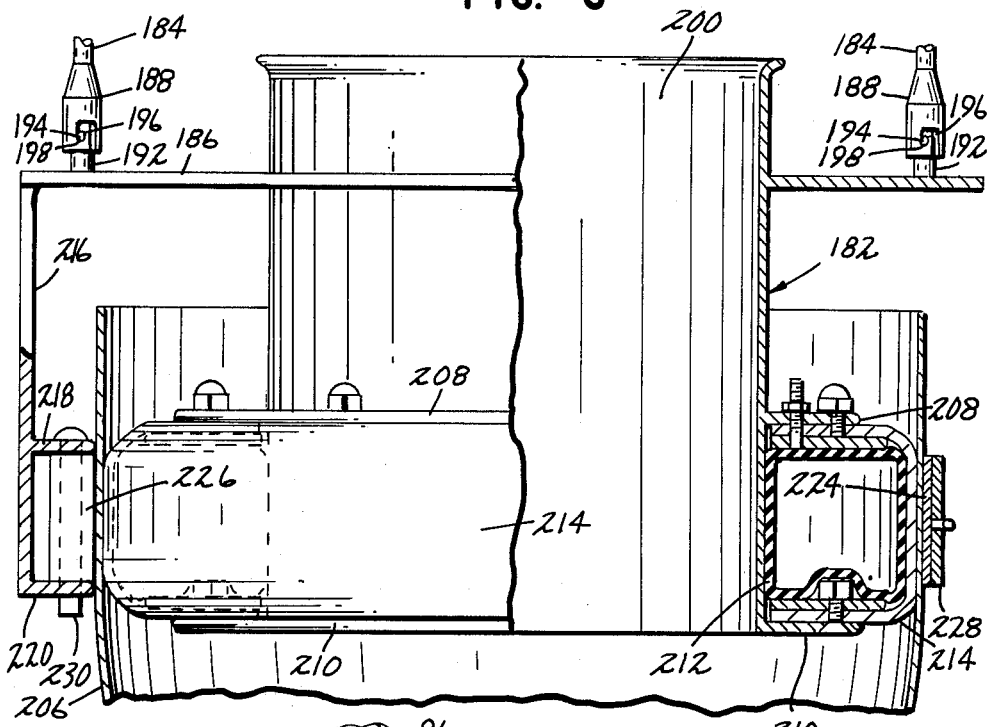
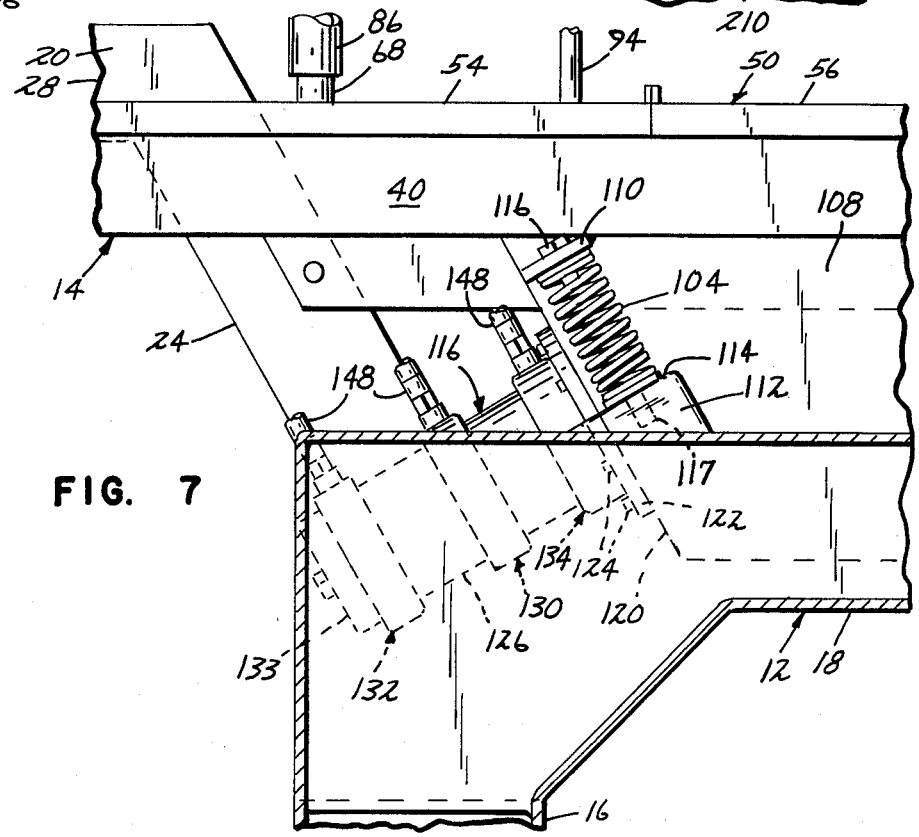
FIG. 7

VIBRATING CONVEYOR FOR USE WITH PACKAGING APPARATUS

TECHNICAL FIELD

The present invention relates broadly to the field of vibratory conveyors. More specifically, the present invention relates to a vibrating conveyor driven by pneumatic vibrators. The vibrating conveyor in accordance with the present invention can be used as a weighing and packaging machine for particulate material.

BACKGROUND OF THE PRIOR ART

Various types of conveyors for conveying particulate material in a packaging machine are known in the prior art. One type of conveyor is an auger type. In an auger type conveyor, the material is conveyed through a chamber by means of a rotating screw or auger. A vibratory type of conveyor has also been used in prior art packaging machines.

A vibratory conveyor used in conjunction with an automatic weighing apparatus is disclosed in U.S. Pat. No. 3,799,280 issued to Aarts. Single direction vibratory conveyors which are used in conjunction with automatic weighing devices are disclosed in U.S. Pat. Nos. 2,352,114 issued to Muskat; 2,687,272 issued to Schieser et al., and 3,195,662 issued to Joiner et al.

A two-way vibrating conveyor is produced by the General Kinematics Corporation of Barrington, Illinois. This vibratory conveyor utilizes electrically driven rotary eccentrics to vibrate the conveying surface.

U.S. Pat. Nos. 2,852,045 issued to Goodner and 4,056,132 issued to Decrane each disclose bag holding mechanisms for use during the filling of the bags with material.

SUMMARY OF THE INVENTION

The present invention is directed to a vibratory conveyor. The conveyor includes a conveying table and a mechanism for supporting the table for vibratory motion. The table has an inlet area disposed generally in the middle of the table for receiving particulate material to be conveyed. A first outlet is disposed on a first side of the table and a second outlet is disposed on a second opposite side of the table. A first pneumatic vibrator is coupled to the table on the first side for vibrating the table and for conveying particulate material from the inlet area to the second outlet. A second pneumatic vibrator is coupled to the table on the second side for vibrating the table and for conveying particulate material from the inlet area to the first outlet.

In a preferred embodiment, a cover is provided which surrounds an upper conveying surface of the conveying table to thereby form a conveying chamber. A mechanism applies a slight negative pressure to the conveying table so that any loose airborne particulate material may be withdrawn from the conveying chamber and recycled. Each vibrator is preferably comprised of a cylindrical housing and a piston pneumatically movable therein. The first vibrator is mounted in a disposition such that a line of impact of the piston of the first vibrator slants generally upwardly from the first side of the conveying table and passes through the conveying table on the second side thereof. The second vibrator is mounted in a disposition such that a line of impact of the second vibrator passes generally upwardly from the second side of the conveying table and passes through the conveying table on the first side thereof.

The present invention is also directed to a bag holder for holding a collapsible bag during the filling thereof by the vibratory conveyor. The bag holder includes a support member which has an upper plate, a bottom plate and an open outer circumferential face. A generally circular shaped flexible tube is supported between the upper and bottom plates. A portion of the flexible tube extends beyond the outer circumferential face when the tube is in an inflated condition. A means is provided for limiting the maximum expansion of the tube when it is inflated. A ring-shaped clamp member is supported around the open outer circumferential face such that an open end of a bag is frictionally held between the tube in its inflated condition and the ring-shaped clamp member. The vibratory conveyor in accordance with the present invention accomplishes rapid and accurate filling of bags with particulate material. Also, continuous operation is accomplished by the two-way feeding mechanism. The use of the cover results in sanitary operating conditions and reduction of particulate loss and waste. The conveyor is particularly suited for conveying fine powdered food products.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

FIG. 6 is a sectional view taken generally along line 6—6 of FIG. 3;

FIG. 7 is an enlarged sectional view illustrating a pneumatic vibrator mounted to one side of a conveying table and a coil spring connecting the conveying table to a frame;

DETAILED DESCRIPTION OF THE INVENTION

Figure 1:
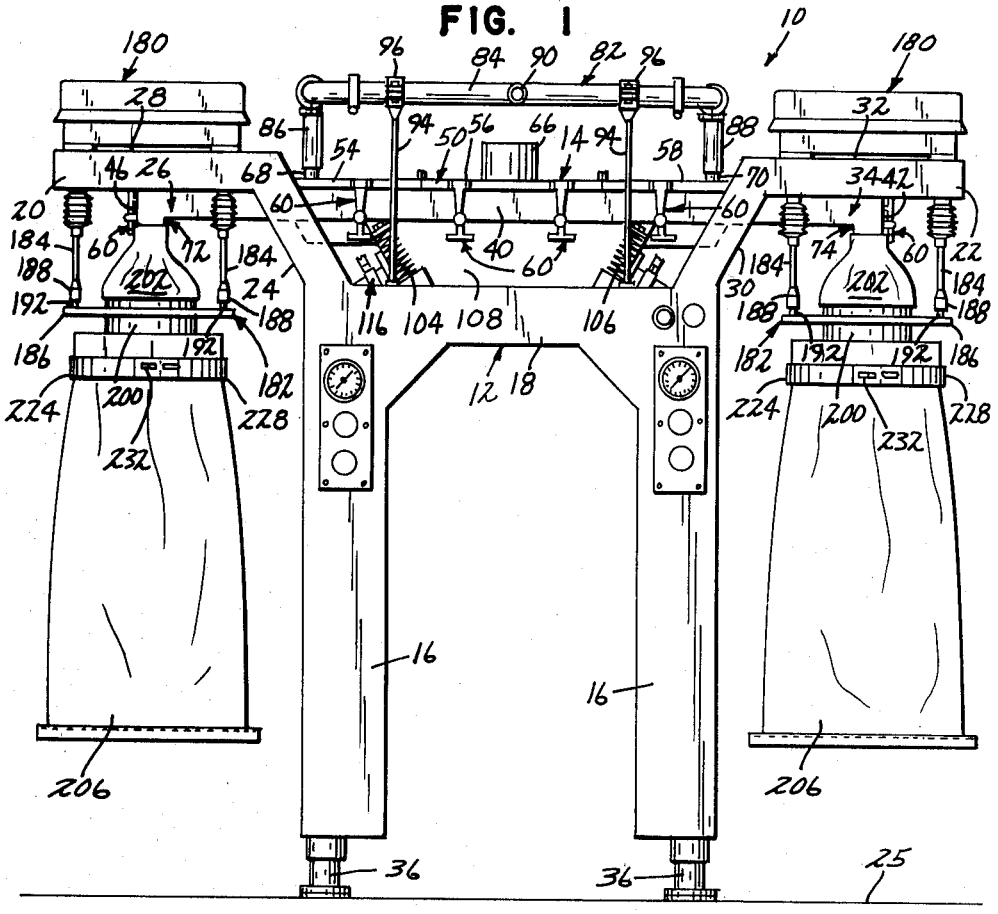
FIG. 1 is a front elevational view of an apparatus in accordance with the present invention.
Figure 2:
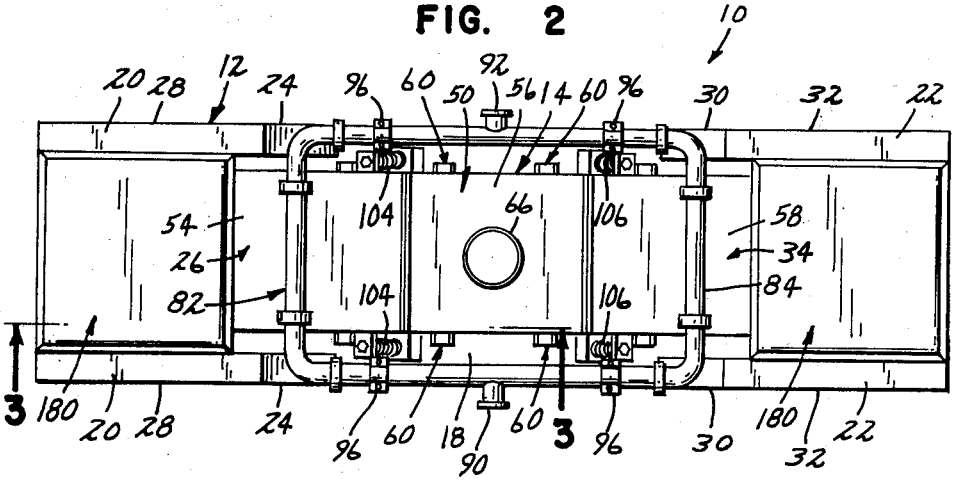
FIG. 2 is a top plan view of the apparatus shown in FIG. 1.

Referring to the drawings in detail wherein like numerals indicate like elements, there is shown in FIG. 1 a vibrating conveyor apparatus indicated generally as 10. The apparatus 10 includes a frame 12 and a conveying table 14 connected to and supported by the frame 12 for vibratory motion. The frame 12 includes four upright members or legs 16, a medial section 18, a first pair of arms 20, and a second pair of arms 22. The lower end of the upright members 16 contact a ground or support surface 25 and the medial section 18 is comprised of a pair of generally horizontally extending members, one of which is connected to the upper ends of a front pair of upright members 16 and the other of which is connected to a rear pair of upright members 16. Each upright member 16 may include an adjustable foot 36 for leveling and adjusting the height of the frame 12. Each arm 20 includes a first section 24 extending upwardly from the medial section 18 at an angle toward a first side 26 of the conveying table 14 and a second section 28 extending from the upper end of the first section 24 in a generally horizontal direction toward the first side 26. Each second arm 22 includes a similar first section 30 and a second horizontally extending section 32 extending toward a second side 34 of the conveying table 14.

Figure 4:
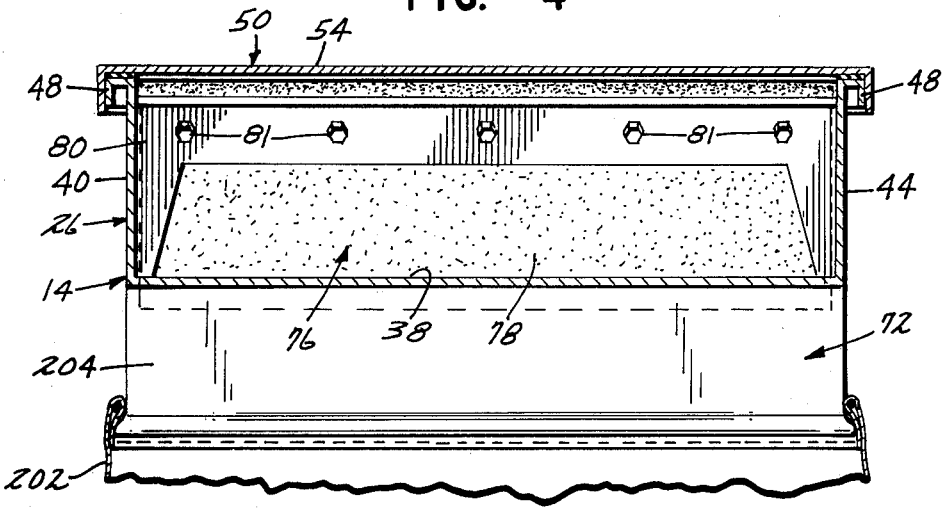
FIG. 4 is a sectional view on an enlarged scale taken generally along line 4—4 of FIG. 3.

The conveying table 14 has a generally planar horizontally extending conveying surface 38. A plurality of side walls 40, 42, 44 and 46 are attached to and extend generally upward from the conveying table 14. Each side wall 40–46 has a flange 48 at its upper end. Each flange 48 has a horizontally and outwardly extending section and a downwardly extending section. A cover member 50 is supported above the side walls 40–46 by their flanges 48. See FIG. 4 wherein two side walls 40, 44 are shown. The cover member 50 is supported in a generally air tight relationship over the conveying surface 38 to thereby form a conveying chamber 52 between the surface 38, the side walls 40–46 and the cover member 50. The cover member 50 may be constructed of a plurality of cover sections 54, 56 and 58.

Each cover section 54–58 is held down securely on the flanges 48 by clamps 60. Each clamp 60 is comprised of a handle 62 pivotably attached to one of the cover sections 54–58 and a clamp bar 64 for frictionally engaging the handle 62 to secure a respective cover section 54–58 in position. The cover section 56 is located generally at the center of the conveying table 14 and has a centrally disposed inlet opening 66. The inlet opening 66 is connected to a source of particulate material which is to be conveyed by the table 14 and thereafter packaged. The inlet opening 66 delivers the particulate material to a generally centrally located inlet area of the conveying surface 38. The cover section 54 has an outlet 68 and the cover section 58 has an outlet 70. In a manner to be explained more fully hereinafter, each outlet 68, 70 is connected to a source of slight negative pressure.

A first dispensing outlet 72 is formed through the conveying table 14 on its first side 26 and a second dispensing outlet 74 is formed through the conveying table 14 on its second side 34. Each outlet 72, 74 is generally rectangular in shape with a lengthwise dimension which extends accross substantially the entire width of the conveying surface 38. A sealing means, designated generally as 76 is disposed adjacent each dispensing outlet 72, 74. Each sealing means 76 is identical and only one sealing means 76 is shown in detail adjacent the dispensing outlet 72. The sealing means 76 prevents the entry of outside air to the conveying chamber 52 upstream of each respective sealing means 76 when an associated dispensing outlet 72, 74 is open to the outside environment. At the same time, the sealing means 76 is movable to permit particulate material to be conveyed past the sealing means 76 and to be dispensed through an outlet 72, 74.

Figure 3:
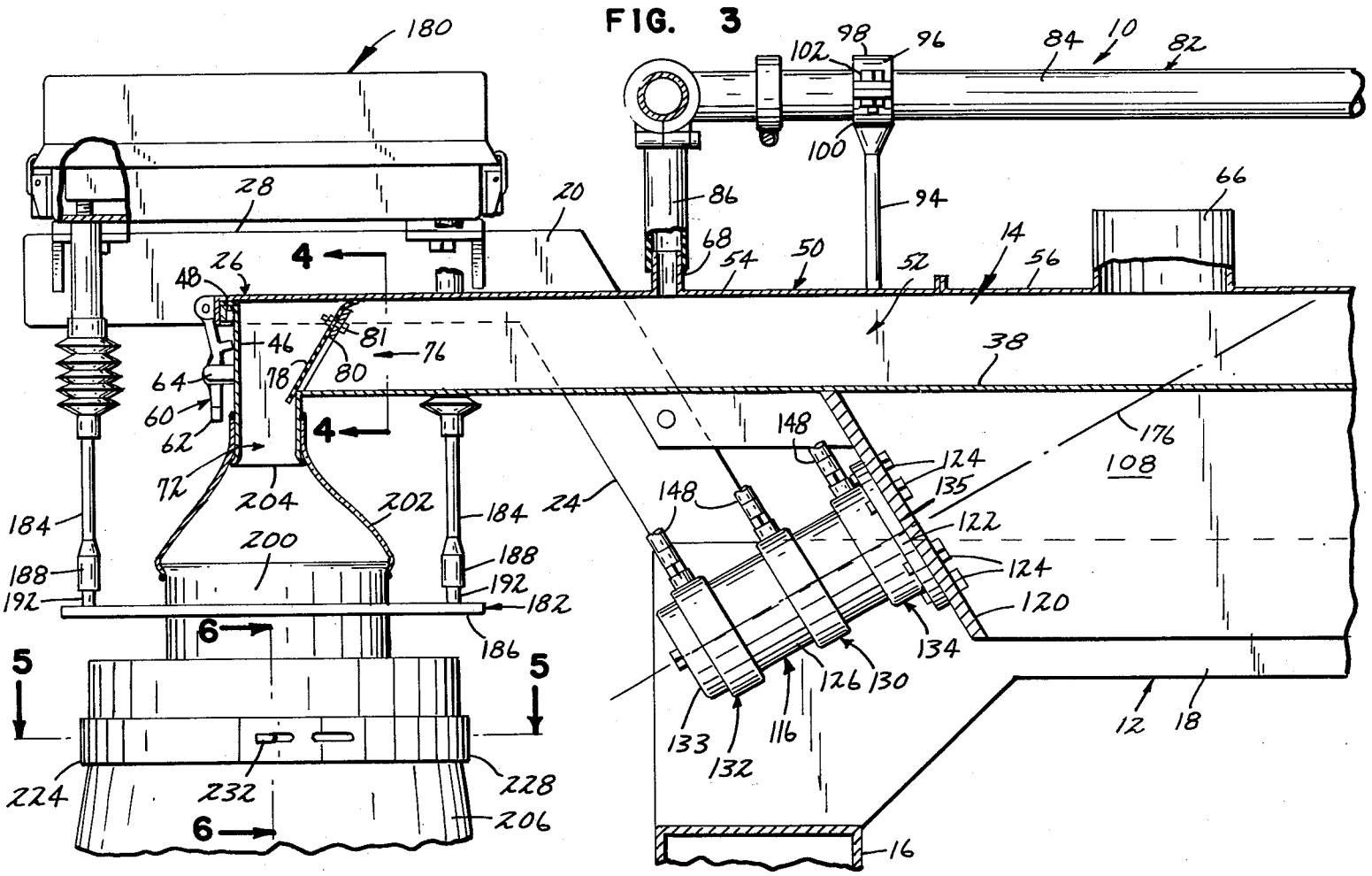
FIG. 3 is an enlarged sectional view taken generally along line 3—3 of FIG. 2.

Each sealing means 76 is comprised of a resilient flap member 78 supported within the conveying chamber 52 by a bracket 80. The mounting bracket 80 has a generally inverted U-shape and is secured to the side walls 40, 44. The flap 78 is preferably made of a resilient rubber or plastic material and has a generally rectangular configuration. The flat 78 is attached to the downstream side of the bracket 80 by fasteners 81. As seen in FIG. 3, the flat 78 extends below the conveying surface 38, contacts an edge of the outlet 72 and extends downwardly into the outlet 72. The flap 78 extends downwardly at an angle such that it rests upon an edge of the conveying table 14 and thus forms a seal. However, the flap 78 is resilient or bendable enough to move when particulate material is being conveyed to the outlet 72.

A means, designated generally as 82, for applying a slight negative pressure to the conveying chamber 52 is coupled in fluid communication to the outlets 68, 70. The means 82 include a common conduit 84 which encircles the conveying table 14 and is placed in fluid communication with the outlets 68, 70 by means of coupling conduits 86, 88 respectively. The common conduit 84 has a pair of outlets 90, 91 which are in fluid communication with a source of negative pressure. The source of negative pressure can also be placed in fluid communication with an inlet conduit for the particulate material so that the particulate material drawn through the conduit 84 may be recirculated. By applying a slight negative pressure to the conveying chamber 52, any loose particles within the conveying chamber 52 can be withdrawn so that dust cannot leak into the environment surrounding the conveying table 14, while at the same time the conveying of particulate material is not disturbed. The conduit 84 is supported by a plurality of support rods 94. The support rods 94 have lower ends attached to the medial section 18 of the frame 12. Clamp members 96 are attached to the upper ends of the rods 94. The clamp members 96 have upper sections 98 which are removably attached to lower sections 100 by fastening means 102. The conduit 84 can thus be removably supported above the conveying table 14.

The conveying table 14 is mounted to the frame 12 by a first pair of coil springs 104 attached to the conveying table on its first side 26 and a second pair of coil springs 106 attached to the conveying table 14 on its second side 34. The connection of one of the coil springs 104 between the conveying table 14 and the frame 18 is illustrated in detail in FIG. 7. The other spring 104 and the springs 106 are connected between the conveying table 14 and the frame 12 in a similar manner. A plate 108 extends generally vertically downward from the conveying table 14 and a mounting flange 110 extends outwardly therefrom. The mounting flange 110 is angled with respect to the horizontal. A mounting projection 112 extends upwardly from the medial section 18 of the frame 12. The mounting projection 112 has a support surface 114 angled with respect to the horizontal at the same angle as the flange 110. The spring 104 has a first upper end secured by a fastener means 116 to the mounting flange 110 and by a fastener means 117 to the projection 112. In this manner, the coil spring 104 extends downwardly from the first side 26 of the conveying table 14 at an angle toward its second side 34. The coil springs 106 are similarly supported at the second side 34 at a downward angle toward the first side 26.

A first linear pneumatic vibrator 116 is mounted to the first side 26 of the conveying table 14 and a second linear pneumatic vibrator 118 is mounted to the second side 34 of the conveying table 14. The mounting of the first pneumatic vibrator 116 is shown in detail in FIG. 3. The second pneumatic vibrator 118 is similarly mounted to the conveying table 14. A mounting plate 120 extends downwardly from the conveying table 14. The mounting plate 120 extends downwardly at an angle from the first side 26 of the table 14 in a direction toward the second side 34. A similar mounting plate for the pneumatic vibrator 118 extends downwardly at an angle from the second side 34 in a direction toward the first side 26. The pneumatic vibrator 116 has a flange 122 at one of its ends which is removably secured to the mounting plate 120 by fasteners or bolts 124. The second pneumatic vibrator 118 is similarly mounted to the mounting plate extending downwardly from the second side 34 of the conveying table 14. The first vibrator 116 vibrates the conveying table 14 in such a manner that particulate material is conveyed to the second outlet 74 and the second pneumatic vibrator 118 conveys particulate material to the first outlet 72.

Figure 8:
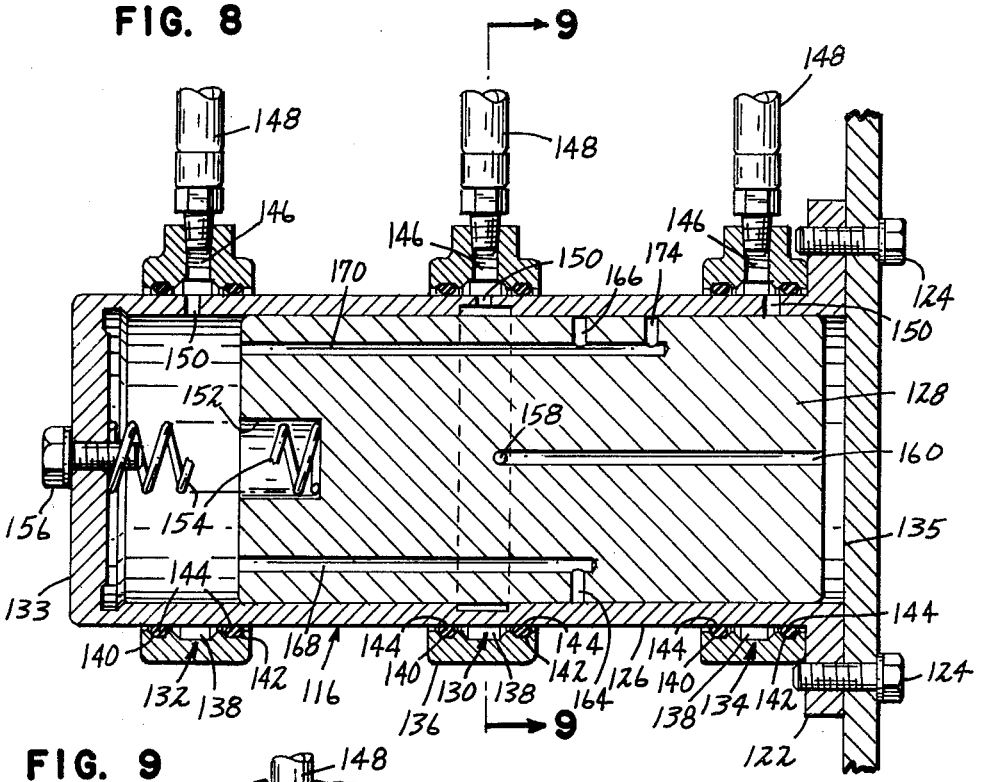
FIG. 8 is a sectional view through a pneumatic vibrator used with the apparatus.
Figure 9:
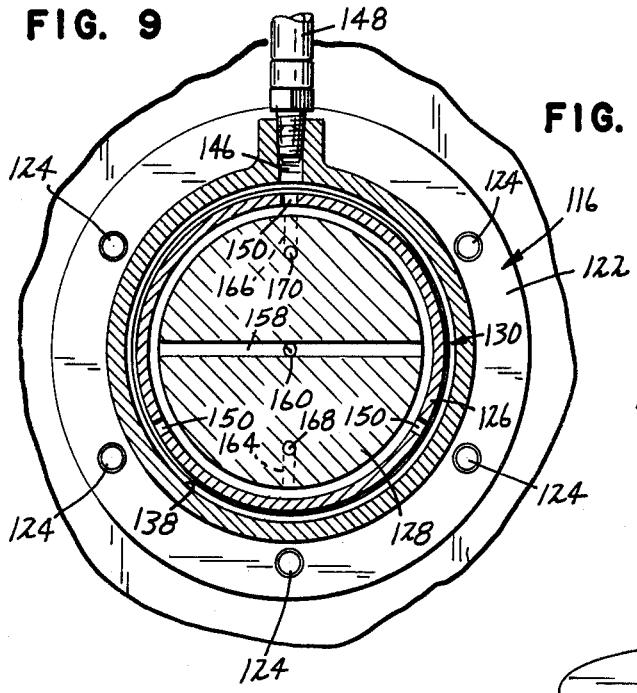
FIG. 9 is a sectional view taken along line 9—9 of FIG. 8.

FIG. 8 is a sectional view illustrating details of the pneumatic vibrator 116. The pneumatic vibrator 118 is similarly constructed. The vibrator 116 includes a generally cylindrical housing 126 and a piston 128 slidably received within the cylindrical housing 126. An inlet manifold 130 is formed generally around the middle of the cylindrical housing 126. A first exhaust manifold 132 is formed around the cylindrical housing 126 adjacent a first end 133 and a second exhaust manifold 134 is formed around the cylindrical housing 126 adjacent its second opposite end 135. Each of the manifolds 130–134 is similarly constructed and, hence, only the manifold 130 will be described in detail and common numerals will be used to indicate common parts in each manifold 130–134.

A ring-shaped sleeve 136 is received about the middle of the cylindrical housing 126 and has a central cut-out area or depression 138. A pair of grooves 140, 142 are formed in the sleeve 136 on either side of the area 138. A compressible sealing ring 144 is received within each of the grooves 140, 142. The sleeve 136 is placed firmly about the housing 126 such that the manifold 130 is formed in the area 138 between the sealing rings 144. An inlet opening 146 is formed through the sleeve 136. The inlet opening 146 is placed in fluid communication with a source of high positive pressure by conduit or tubing 148. The fluid pressure applied to the manifold 130 is transferred through the cylindrical housing 126 to the piston 128 via a plurality of equally-spaced holes 150. A plurality of holes 150 also communicate with each exhaust manifold 132, 134. The conduits 148 which are in communication with the exhaust manifolds 132, 134 each serve to exhaust air from the interior of the cylindrical housing 126.

The piston 128 has a short bore 152 in one of its ends. A spring 154 is received within the bore 152 and is held in alignment therewith by a bolt 156 which passes through the end 133 of the housing 126. The spring 154 biases the piston 128 to the right as shown in FIG. 8. A plurality of passages are formed through the piston 128 to communicate the fluid pressure to opposite ends of the interior of the housing 126 to thereby reciprocate the piston 128. Passages 158, 160 provide fluid communication between the inlet manifold 130 and the second end 135 of the housing 126. Passages 164, 166, 168 and 170 provide fluid communication between the inlet manifold 130 and the first end 133 of the housing 126. A passage 174 may be provided for starting the vibrator 116 if a spring 154 is not provided. By utilizing the plurality of openings 150 at each manifold 130–134, the amount of fluid pressure required to move the piston 128 can be lower than in conventional vibrators.

The vibrator 116 operates in a conventional manner. When fluid pressure is applied to the inlet manifold 130, it is communicated to the second end 135 through the passages 158, 160 when the piston is in the position shown in FIG. 8. The pressure applied to the second end 135 moves the piston 128 towards the first end 133. As the piston 128 passes the openings 150 to the exhaust manifold 132, the air at the first end 133 begins to compress. At approximately the same time, air is being supplied to the first end 133 through the passages 164–170 (the passages 158, 160 have moved out of communication with the inlet manifold 130). The compressed air at the first end 133 and the air being supplied through the passages 164–170 bounces the piston back toward the second end 135. A similar air compression occurs at the second end 135 and the fluid pressure is again supplied through the conduits 158, 162 to bounce the piston in the reverse direction back toward the first end 133. The speed and force with which the piston 128 travels can be increased by increasing the pressure supplied through the inlet manifold 130. Conversely the speed and force with which the piston 128 travels can be lowered by lowering the pressure supplied through the inlet manifold 130.

The cylindrical housing 126 and the piston 128 of the pneumatic vibrators 116, 118 have a mass relationship between each other which optimizes their operation for conveying particulate material. Since the force of the moving piston 128 provides the vibratory force, the piston 128 is made to have at least twice the mass of the cylindrical housing 126. A vibrator 116, wherein the piston 128 is formed of a brass material weighing 47 pounds and the cylindrical housing 126 is made of a material weighing approximately 13 pounds, has been found suitable. When this type of piston 128 and cylindrical housing 126 in combination with the plurality of openings 150, it has been found that the vibrator can be operated at pressures as low as 5 psi.

The axis of the cylindrical housing 126 in which the piston 128 travels is shown as line 176 in FIG. 3. The line 176 thus corresponds to the effective line of travel of the piston 128 and the effective force line of the vibrator 116. As shown therein, the line 176 passes from the first side 26 of the conveying table 14 and passes through the conveying table 14 on the second side 34 thereof. Also as shown therein, the line 176 and the vibrator 116 are disposed at an angle of approximately 30° above the horizontal. The axis of the cylindrical housing 126 of the second vibrator 118 similarly extends from the second side 34 and passes through the conveying table 14 on the first side 26 thereof. By arranging the vibrators 116, 118 in such a manner, conveying in two directions by vibrating one of the vibrators 116, 118 at a time is accomplished. Also by quickly reversing the operation of the vibrators 116, 118, a quick reversal of conveying direction is attained and, hence, an accurate feed cut-off is attained.

Figure 10:
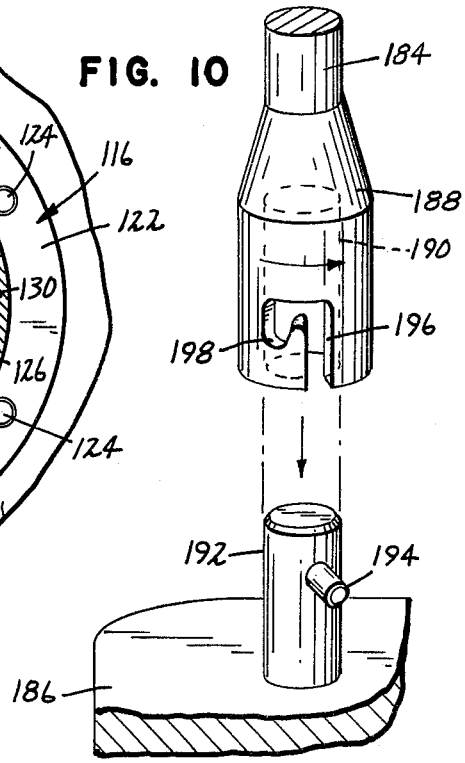
FIG. 10 is an enlarged prospective view of a coupling member for coupling a bag holder to a weighing device in the apparatus.

So that the particulate material being dispensed from the outlets 72, 74 can be packaged, a weighing means 180 and a bag holding means 182 are supported on each pair of arms 20, 22. The weighing means 180 can be a conventional weighing device. The weighing means 180 preferably provides an electrical weight measurement output. The bag holding means 182 is coupled to the weighing means 180 by a plurality of connecting rods 184. The connecting rods 184 extend downwardly from a movable portion of the weighing means 180 and are connected to a top plate 186 of the bag holding means 182. The lower end of a connecting rod 184 is shown in detail in FIG. 10. As shown therein, a coupling receptacle 188 forms the lower end of the connecting rod 184. The receptacle 188 has a hollow core 190 adapted to receive a pin 192 which extends upwardly from the plate 186. A locking pin 194 extends outwardly from the pin 192 and is received within a slot 196 in the coupling receptacle 188. The slot 196 has a detent 198 for locking the pin 194 in position. In this manner, the bag holding means 182 is connected to the weighing means 180.

Figure 5:
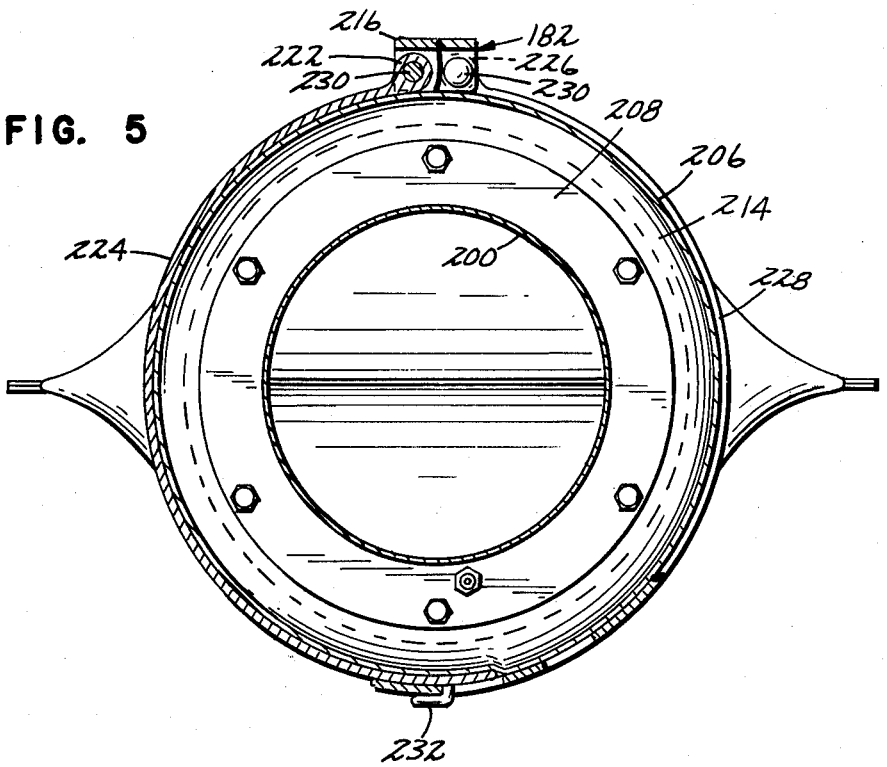
FIG. 5 is a sectional view taken generally along line 5—5 of FIG. 3.

The bag holding means 182 at the first side of 26 of the conveying table 14 can best be seen in FIGS. 3, 5 and 6. The bag holding means 182 at the second side 34 of the conveying table 14 is similarly constructed. A central guide chute or tube 200 extends above and below the top plate 186. A removable and flexible dust cover 202 is attached between a top end of the guide chute 200 and a generally rectangular extension 204 of the outlet 72. The lower end of the guide chute 200 is in communication with a bag 206 when it is held by the bag holding means 182.

A ring-shaped upper plate 208 and a ring-shaped lower plate 210 are attached along their inner surfaces to the guide chute 200. An open outer circumferential area is defined between the outer circumferences of the upper and lower plates 208, 210. A flexible and expandable member or tube 212, such as a tire innertube, is supported between the upper and lower plates 208, 210. So that the maximum expansion of the flexible tube 212 can be limited, a flexible but not expandible protective layer of material 214 is placed around the flexible tube 212. The layer 214 can be a non-stretchable nylon sheath. A support arm 216 extends downwardly from the top plate 186. An upper support flange 218 and a lower support flange 220 extend from the arm 216. A curved tail section 222 of a generally semicircular clamp member 224 is supported between the flanges 218, 220 and a curved tail section 226 of a generally semicircular clamp member 228 is also supported between the flanges 218, 220. The clamp members 224, 228 are held for pivotable motion between the flanges 218, 220 by a pair of pins 230 passing through the tail sections 222, 226. The clamp member 224 has a locking pin 232 adjacent its free end which is received within a slot in the clamp member 228 when the clamp members 228, 224 are in a closed position shown in the Figures. As is best seen in FIG. 6, the upper end of the bag 206 is frictionally held between the layer 214 and the clamp members 224, 228 when the flexible tube 212 is inflated. In this manner, a bag 206 can be held during a filling operation by the bag holding means 82 and simultaneously weighed by the weighing means 180. The bag holding means provides a firm grip on the bag 206 through a full 360° extent.

Figure 11:
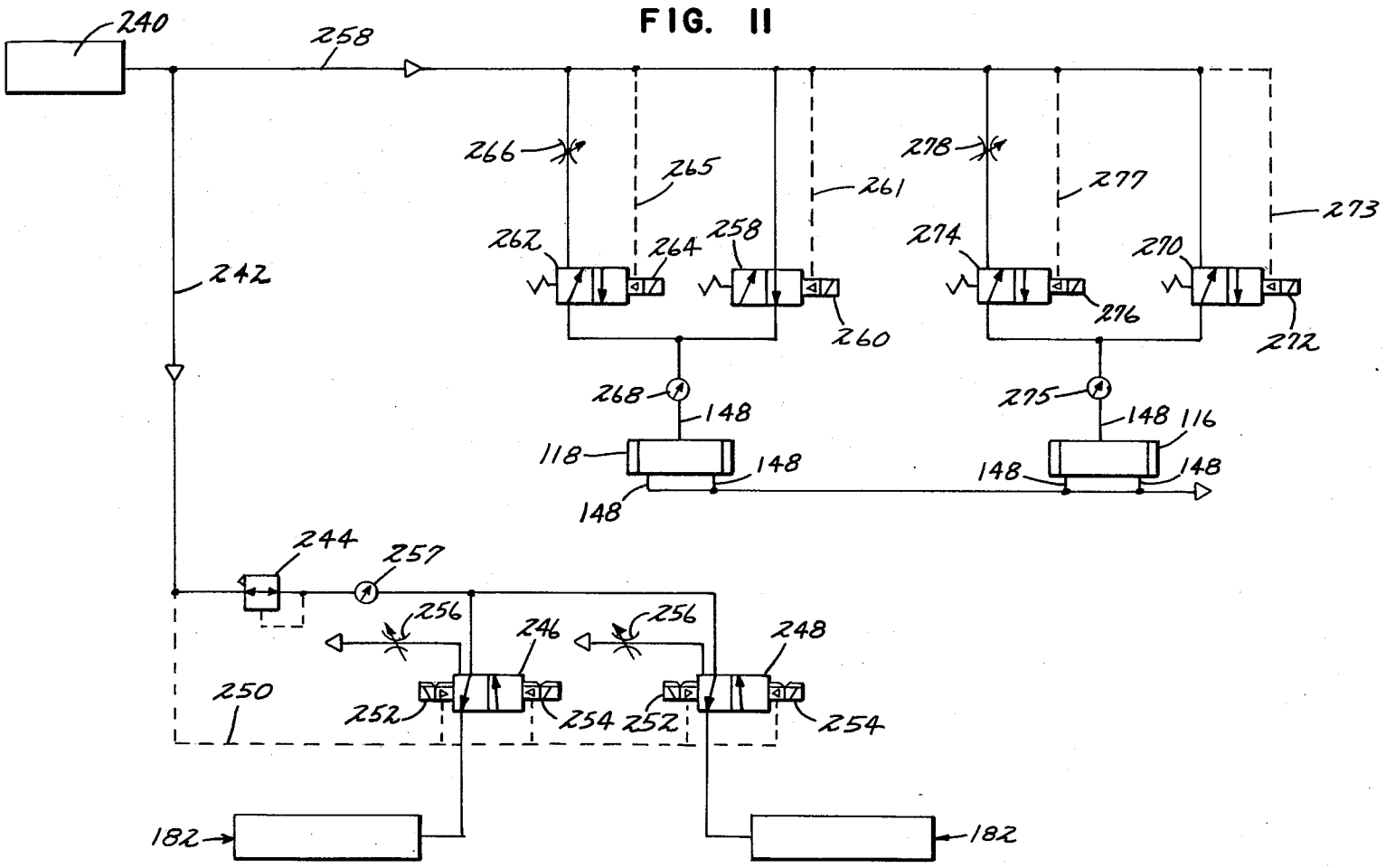
FIG. 11 is a schematic diagram of a pneumatic control mechanism for use with the apparatus.

The operation of the apparatus 10 will be explained with reference to the circuit shown in FIG. 11. As shown therein, a conventional source 240 of high fluid pressure is provided. The fluid pressure is supplied through line 242 to the two bag holding means 182. Operating fluid pressure is supplied through a pressure regulator 244 and through a control valve 246 to control one of the bag holding means 182. The operating fluid pressure is supplied to the other bag holding means 182 through the pressure regulator 244 and a second control valve 248. The control valves 246, 248 and their operation are the same, hence, only the detailed and operation of the valve 246 will be discussed. A pilot air control line 250 supplies pilot air to the pilot valves 252, 254. The pilot valves 252, 254 control the position of control valve 246. The pilot valves 252, 254 can be actuated by a foot operated switch. In the position shown in FIG. 11, the control valve 246 is in a position wherein high pressure air is passed through the valve 246 to the bag holding means 182. If the valve 246 is moved to its opposite position, air is passed through a restrictive bleed valve 256. The restrictive bleed valve 256 passes the air slowly from the flexible member 212 of one of the bag holding means 182 so that the bag 206 does not drop suddenly. Thus, by controlling the position of the valves 246, 248, bag 206 can be attached to and detached from the bag holding means 182. The amount of air pressure supplied to the bag holding means 182 can be read by an air indicator 257.

A line 258 is provided for supplying high fluid pressure to the vibrators 116, 118. A plurality of spring biased solenoid control valves control the flow of high pressure fluid to the pneumatic vibrators 118, 116. As shown in FIG. 11, a solenoid control valve 258 has been activated by pilot valve 260 such that high fluid pressure is applied to the vibrator 118 at its full operating pressure. Air is supplied to the pilot valve 260 through a pilot air line 261. The apparatus 10 is now in a high speed mode and delivering particulate material at a high speed to the left. When the weighing means 180, on the left side 26, detects that the bag 206 is near a preselected desired full state, the valve 258 is deactivated and a solenoid valve 262 is activated through a pilot valve 264. The pilot valve 264 is activated by air supplied through a pilot air line 265. Air is thus supplied through a restriction means 266 which reduces the pressure of the air supplied through valve 262. The vibrator 118 is thus driven at a slow speed. The apparatus 10 is now delivering particulate material at a low speed to the left. The pressure at which fluid is being supplied to the vibrator 118 can be measured by an indicator 268. When the weighing means 180 registers that the preselected value has been reached, the solenoid valve 262 is deactivated and a solenoid valve 270 is activated through a pilot valve 272. The pilot valve 272 is supplied with air through pilot air line 273. The pressure at which air is supplied to the vibrator 116 can be read on an indicator 275. The fluid pressure is thus supplied to the vibrator 116 and the particulate material is now conveyed to the right at a high speed. This quick reversal of operation of the vibrators 116, 118 results in fast and accurate cut-off of the feed of the particulate material. A bag 206 has been filled with an accurate amount of material and the delivery of material to another bag 206 is initiated immediately. When the weighing means 182 detects that the bag 206 at the right hand side 34 of the apparatus 10 is near a preselected value, solenoid valve 270 is deactivated and a solenoid valve 274 is activated through a pilot valve 276, which is supplied air through pilot air line 277. The fluid pressure is thus applied through a restriction means 278 at a lower pressure. The vibrator 116 thus operates at a slower speed and delivers the particulate material at a slower speed. Once the preselected amount has been weighed by the weighing means 182, the solenoid valve 274 is deactivated and the solenoid valve 258 is activated. In this manner conveying of the particulate material is again automatically reversed and conveying is initiated to the left. This operation can be continually repeated so that a continuous delivery of particulate material alternates from the left hand side 26 to the right hand side 34 of the apparatus 10.

Numerous characteristics and advantages of the invention have been set forth in the foregoing description together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extend extended by the broad general meaning of the terms in which the appended claims are expressed.

What is claimed is:

1. A vibrating conveyor for conveying material comprising:

a conveying table, said table having an inlet area disposed generally in the middle of said table for receiving particulate material to be conveyed, a first outlet disposed on a first side of said table and a second outlet disposed on a second opposed side of said table;

means for supporting said table for vibratory motion;

a first pneumatic linear vibrator coupled to said table on said first side for vibrating said table and for conveying particulate material from said inlet area to said second outlet;

a second pneumatic linear vibrator coupled to said table on said second side for vibrating said table and for conveying particulate material from said inlet area to said first outlet;

each linear vibrator including a housing and a piston movably carried therein for motion in a linear direction forming the line of impact of a respective piston;

means for mounting said first linear vibrator to said table in a disposition such that the line of impact of the first vibrator's piston slants generally upward from said first side of conveying table toward said second side thereof;

means for mounting said second linear vibrator to said table in a disposition such that the line of impact of the second vibrator's piston slants generally upward from said second side of said conveying table toward said first side thereof; wherein in each vibrator the piston has a mass at least as large as the mass of the housing; and means for controlling the application of fluid pressure to said first and second linear vibrators whereby the application of fluid pressure to one of said vibrators can be stopped and the application of fluid pressure to the other of said vibrators immediately initiated to quickly reverse the direction of conveying.

2. A vibrating conveyor in accordance with claim 1 including a cover means for surrounding an upper conveying surface of said conveying table to thereby form a conveying chamber.

3. A vibrating conveyor in accordance with claim 2 wherein said conveying table is comprised of a generally planar plate and said cover member is comprised of a plurality of side walls extending upwardly from said planar plate and a top wall covering and extending between said side walls.

4. A vibrating conveyor in accordance with claim 3 wherein a plurality of clamp members secure said top wall to said side walls.

5. A vibrating conveyor in accordance with claim 4, wherein said top wall is divided into a plurality of cover sections, a first cover section being disposed on the first side of said conveying table, a second cover section being disposed on the second side of said conveying table and a medial cover section being disposed between said first and second cover sections above said inlet area.

6. A vibrating conveyor in accordance with claim 5 including means for applying negative pressure to said conveying chamber, said last-mentioned means including a conduit in fluid communication with a negative pressure source and in fluid communication with said conveying chamber through an outlet formed in said first cover section and through an outlet formed in said second cover section.

7. A vibrating conveyor in accordance with claim 2 or 3 including inlet means to said conveying chamber for supplying the particulate material to said inlet area and sealing means disposed between said inlet means and each of said outlet means for preventing the entry of outside air to said conveying chamber upstream of said sealing means when said outlet means is open to the surrounding environment, and wherein said outlet is formed as a slot through said conveying surface, each slot having an outlet edge over which the material being conveyed passes.

8. A vibrating conveyor in accordance with claim 6 wherein said sealing means is comprised of a resilient flap disposed between said inlet means and a respective outlet means, each resilient flap slanting downwardly toward a respective outlet, resting along the outlet edge of one of said slots and being movable upwardly when said particulate material is being conveyed thereby toward one of said outlets to thereby permit the particulate material to be conveyed past said resilient flap to one of said outlets.

9. A vibrating conveyor in accordance with claim 2 including means for applying negative pressure to said conveying chamber.

10. A vibrating conveyor in accordance with claim 1 or 2 wherein said line of impact of the piston of said first vibrator slants generally upwardly from said first side of said conveying table and passes through said conveying table on the second side thereof, and said line of impact of the piston of said second vibrator passes generally upwardly from the second side of said conveying table and passes through said conveying table on the first side thereof.

11. A vibrating conveyor in accordance with claim 10 wherein each vibrator has an inlet manifold disposed approximately at the middle of said housing and an exhaust manifold adjacent each opposite end of said housing, a plurality of holes being formed through said housing to provide fluid communication between said inlet manifold and the interior of said housing, and a plurality of holes beinf formed through said housing adjacent each exhaust manifold to provide fluid communication between the interior of said housing and each respective exhaust manifold.

12. A vibrating conveyor in accordance with claim 1 including weighing means supported adjacent each of said outlets for weighing the particulate material being conveyed through each respective outlet.

13. A vibrating conveyor in accordance with claim 1 including bag holding means supported adjacent each of said outlets for supporting a collapsible bag to be filled with the particulate material being conveyed through each outlet.

14. A vibrating conveyor in accordance with claim 13 including a frame for supporting said conveying table for vibratory motion, said frame having arm means extending on said first and second sides for supporting bag holding means.

15. A vibrating conveyor for conveying particulate material comprising:

a support frame;

a conveying table, said conveying table having an inlet are generally in the middle thereof for receiving particulate material to be conveyed, a first outlet disposed on a first side of said conveying table and a second outlet disposed on a second opposite side of said conveying table;

means for mounting said conveying table to said frame for vibratory motion with respect thereto;

a first pneumatic linear vibrator, said first linear vibrator including a housing and a piston movably carried therein for motion in a linear direction forming the line of impact of the first vibrator;

means for connecting said first vibrator to the first side of said conveying table so that the line of impact of said first vibrator passes through said conveying table on the second side thereof;

a second pneumatic linear vibrator, said second linear vibrator including housing and a piston movably carried therein for motion in a linear direction forming the line of impact of said second vibrator;

means for connecting said second vibrator to the second side of the conveying table so that the line of impact of said second vibrator passes through said conveying table on the first side thereof;

wherein in each vibrator the piston has a mass at least twice as large as the mass of the housing; and means for controlling the application of fluid pressure to said first and second linear vibrators whereby the application of fluid pressure to one of said vibrators can be stopped and the application of fluid pressure to the other of said vibrators immediately initiated to quickly reverse the direction of conveying.

16. A vibrating conveyor in accordance with claim 15 wherein the housing of each vibrator is comprised of a cylinder and each piston is pneumatically movable along the axis of one of said cylinders, the line of impact of said first vibrator passing along the axis of the cylinder of said first vibrator and the line of impact of said second vibrator passing along the axis of the cylinder of said second vibrator.

17. A vibrating conveyor in accordance with claim 16 wherein each line of impact extends at an angle of approximately 30° above the horizontal.

18. A vibrating conveyor in accordance with claim 15 or 16 or 17 wherein said mounting means is comprised of a plurality of coil springs having first ends attached to said conveying table and second ends attached to said frame.

19. A conveying apparatus in accordance with claim 18 wherein said plurality of coil springs includes a first set of coil springs disposed on the first side of said conveying table and extending downwardly from said conveying table at an angle toward the second side of said conveying table and a second set of coil springs disposed on the second side of said conveying table and extending downwardly from said conveying table at an angle toward the first side of said conveying table.

20. A vibrating conveyor in accordance with claim 19 wherein each coil spring has a lengthwise dimension which extends at an acute angle above the horizontal.

21. A vibrating conveyor in accordance with claim 15 or 16 including a cover means for surrounding the conveying surface of said conveying table to form a conveying chamber above the conveying surface and a sealing means disposed between said inlet area and each of said outlets for preventing the entry of outside air from said outlets to the interior of said conveying chamber upstream of said sealing means.

22. A vibrating conveyor in accordance with claim 15 or 16 including a bag holding means supported adjacent each of said outlets for supporting a bag to be filled with the particulate material being conveyed and a weighing means supported adjacent each of said outlets for weighing the amount of material being filled into a bag held by one of said bag holders.

23. A vibrating conveyor for use in an apparatus for weighing and packaging particulate material comprising:

a frame including upright members for contacting a support surface and extending generally upwardly therefrom, a first pair of arms connected to said upright members and extending generally to a first side of said conveyor, and a second pair of arms connected to said upright members and extending generally to a second opposite side of said conveyor a conveyor table having a conveying surface and a cover means for forming a conveying chamber about said conveying surface, said conveying surface having a generally centrally disposed inlet area for receiving material to be packaged, a first outlet disposed on a first side of said inlet area adjacent a first end of said conveying table, a second outlet disposed through a second opposite side of said inlet area adjacent to a second end of said conveying table;

a first sealing flap carried within said conveying chamber for preventing the entry of outside air through said first outlet to an area upstream of said first sealing flap, said first flap being disposed between said first outlet and said inlet area;

a second sealing flap carried within said conveying chamber for preventing the entry of outside air through said second outlet to an area upstream of said second sealing flap, said second sealing flap being disposed between said second outlet and said inlet area;

a first mounting plate connected to said conveying table on the first side thereof and extending downwardly at an angle toward the second side of said conveying table;

a second mounting plate connected to said conveying table on the second side thereof and extending downwardly at an angle toward the first side of said conveying table;

first and second pairs of coil springs for connecting said conveying table to said frame for vibratory motion with respect thereto, said first pair of coil springs being disposed on the first side of the conveying table and extending downwardly from the conveying table to said frame at an angle slanted toward the second side of said conveying table, said second pair of coil springs being disposed on the second side of the conveying table and extending downwardly from the conveying table to said frame at an angle slanted towards the first side of the conveying table;

a first pneumatic vibrator attached to said first mounting plate, said vibrator being comprised of a cylinder and a piston pneumatically driven along the axis of said cylinder, a line passing through said axis forming a driving line of said first vibrator, said driving line passing upwardly from said cylinder toward the second side of said conveying table and passing through said conveying table on the second side thereof;

a second pneumatic vibrator attached to said second mounting plate, said second vibrator being comprised of a cylinder and a piston pneumatically driven along the axis of said last-mentioned cylinder, a line passing through said last-mentioned axis forming a driving line of said second vibrator, the driving line of said second vibrator passing upwardly from the cylinder of said second vibrator toward the first side of said conveying table and passing through said conveying table on the first side thereof;

weighing means attached to each of the pairs of arms for weighing the material being packaged at each of said outlets; and control means for stopping the operation of one of said vibrators and starting the operation of the other of said vibrators when a desired amount of material has been packaged by the one of said vibrators.

* * * * *

UNITED STATES PATENT AND TRADEMARK OFFICE

CERTIFICATE OF CORRECTION

PATENT NO. : 4,241,769

DATED : December 30, 1980

INVENTOR(S) : Dale E. Wiesner

It is certified that error appears in the above–identified patent and that said Letters Patent are hereby corrected as shown below:

Column 4, line 9, "flat" should be --flap--;

Column 4, line 11, "flat" should be --flap--;

Column 4, line 26, "91" should be --92--;

Column 5, line 9, "The" should be --A--;

Column 10, line 61, "beinf" should be --being--.

Signed and Sealed this

Nineteenth Day of May 1981

[SEAL]

Attest:

RENE D. TEGTMEYER

Attesting Officer

Acting Commissioner of Patents and Trademarks